United States Patent [19]

Russo

[11] 4,316,446

[45] Feb. 23, 1982

[54] WOODBURNING HEATER WITH PROTECTED VIEWING WINDOW

[75] Inventor: Richard A. Russo, Holbrook, Mass.

[73] Assignee: Russo Manufacturing Corp., Randolph, Mass.

[21] Appl. No.: 52,121

[22] Filed: Jun. 25, 1979

Related U.S. Application Data

[62] Division of Ser. No. 936,357, Apr. 18, 1977, abandoned.

[51] Int. Cl.[3] ..... F23M 7/00

[52] U.S. Cl. ..... 126/200; 126/193; 126/192; 126/126

[58] Field of Search ..... 126/121, 200, 190, 191, 126/60, 58, 65, 64, 126, 138, 141, 198, 192

[56] References Cited

U.S. PATENT DOCUMENTS

| | | | |
|---|---|---|---|
| 3,757,766 | 9/1973 | Stevenson | 126/200 |
| 4,091,794 | 5/1978 | Stites | 126/121 |

*Primary Examiner*—Samuel Scott
*Assistant Examiner*—G. Anderson
*Attorney, Agent, or Firm*—Thompson, Birch, Gauthier & Samuels

[57] ABSTRACT

In a wood burning heater of the type having a relatively large glass window in the side of the heater for viewing the fire within the heater box, a door for shielding the glass window from the fire when the door is closed, a vent for controlling the flow of air to cool the glass and means for opening and closing the door, such that the vent must be open permitting air flow to cool the window in order for the door to be opened.

3 Claims, 8 Drawing Figures

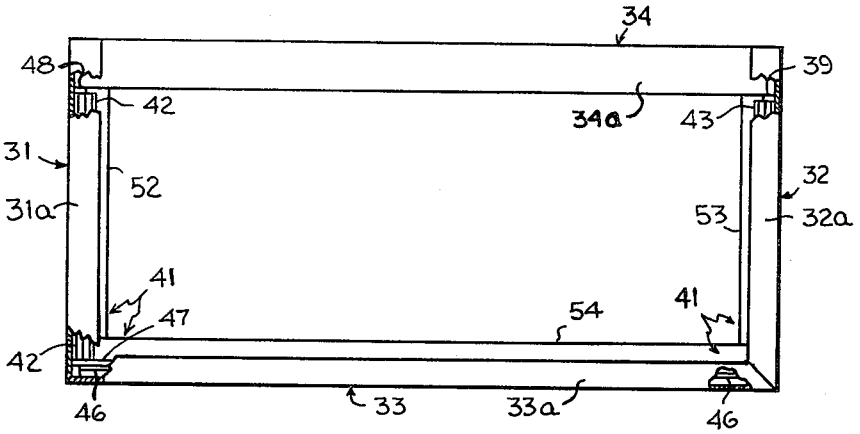
FIG 3
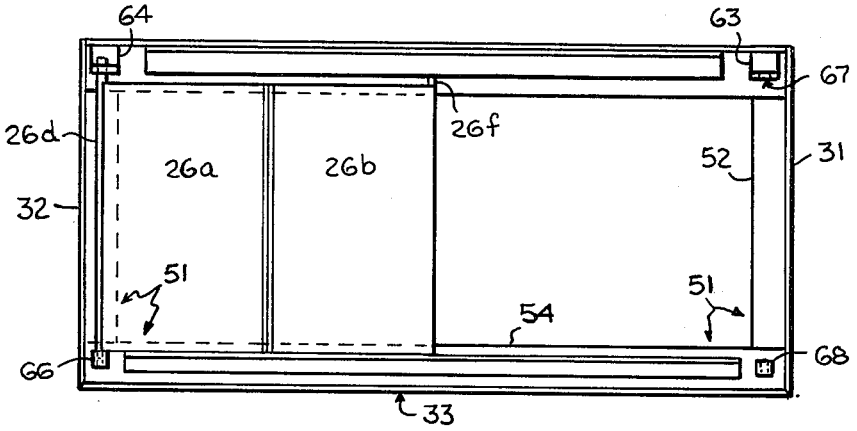
FIG 4
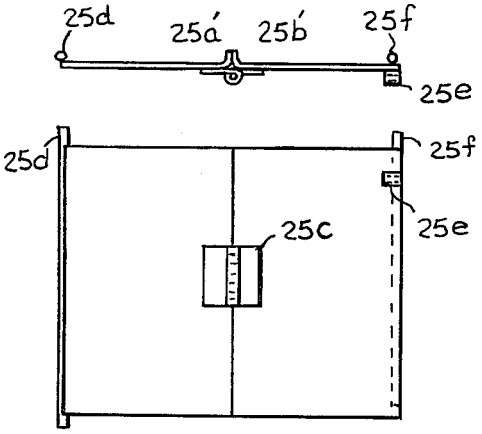
FIG 7
FIG 6
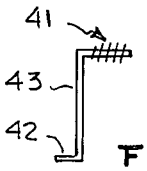
FIG 8
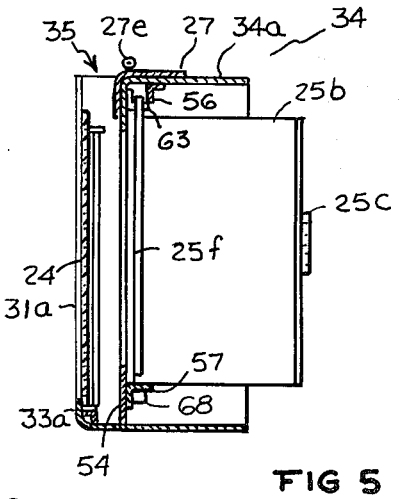
FIG 5

WOODBURNING HEATER WITH PROTECTED VIEWING WINDOW

This is a division of application Ser. No. 936,357 filed Apr. 18, 1977, now abandoned.

BACKGROUND OF THE INVENTION

This invention relates to wood burning heaters or stoves and more particularly to such a heater having an enlarged side window through which the fire can be viewed for the enjoyment of the occupants of the room wherein the heater is located.

Heretofore, woodburning heaters or stoves have included a fire box that is loaded with logs through a side door, a flue pipe usually emanating from the top of the fire box and a base that sets on the floor and holds the fire box. It has been proposed to provide a large opening in one side of the fire box, and a window housing in the opening projecting away from the box and containing a glass window at the projecting end thereof. The window is protected by a single folding door that folds up and down by manipulating handles that attach to the door on each side thereof and extend through slots at the side of the projecting window housing. Cooling air flow past the window on the fire box side thereof is controlled by a vent door at the top of the projecting window housing so that when the vent door is open, cooling air flows in the open vent door and past the glass window. This keeps the window from overheating and tends to prevent soot from gathering on the inside surface of the window. With this arrangement and others used in the past where a viewing glass window is provided, it is most important that the vent be open, allowing cooling air to flow by the glass window whenever the shielding door is open. If the vent is not open completely when the shielding door is open, the glass window may overheat and/or become coated with soot. It is one object of the present invention to provide a wood burning stove with a viewing window so designed that his problem is avoided.

SUMMARY OF THE INVENTION

It is an object of the present invention to provide a heater wherein fuel is burned in a fire box and a glass window is provided for viewing the fire in the box.

It is a particular object to provide an improved wood burning stove or heater having a relatively large glass window in the side of the heater for viewing the fire within, for the pleasure of the viewer and for transmitting radiant heat from the fire to the viewer.

It an another object to provide a wood burning stove or heater having a arelatively large glass window in the side of the heater for viewing the fire within, so constructed that an adequate flow of cooling air for cooling the glass window is insured whenever the window is not protected by a shield.

It is another object in conjunction with the foregoing object to provide such a heater or stove wherein some of the limitations of prior designs are avoided.

It is another object to provide a wood burning heater or stove having a relatively large glass window in the front of the heater for viewing the fire within, a vent for controlling cooling air flow past the window and a door for shielding the window from the fire, so constructed that the same implement is used for controlling the vent and opening and closing the shielding door.

In a prefered embodiment of the present invention a fire box having a generally rectangular squared off shape with legs projecting from the bottom so that it can stand on the floor, has a loading door at one of the smaller sides, a flue vent at the back or the top and, at the front, a very large rectangular opening only a little smaller than the front side of the fire box; and from the opening projects a laterally extending window housing with a glass window in the extending end thereof that affords the user a view of the log fire wihtin the fire box and, or course, also transmits radiation heat directly from the fire to the user.

In the same extending housing, fully blocking the opening in the fire box is a shielding side folding door that may be in two sections, one section folding to the right and the other to the left, fully exposing the opening in the fire box to the viewer through the glass window. At the top of the extending window housing, preferably extending the full width of the housing is a vent cover member that can be manipulated by the user to open and close positions. When the vent member is in the open position, cooling air flows in at the window as necessary to protect it from the heat of the fire in the fire box when the shielding doors are open, and, in addition, access to the shielding doors so that they can be opened and closed by the user is through the vent opening at the top when the vent member is open. Hence, the vent has to be opened before the doors can be manipulated by the user. This tends to insure that the shielding doors will not be open exposing the glass window to the heat of the fire until the vent allowing cooling air to flow past the window is open.

Another feature of the present invention lies in the novel construction of the side folding door, the tool for engaging the door to open and close it, the accomodation on the door that is engaged by the tool and the manner in which the door is hung and hinged.

Other objects and features of the present invention will be apparent from the following specific descriptions of an embodiment of the invention which represents the best known use of the invention, taken in conjunction with the drawings.

DESCRIPTIONS OF THE DRAWINGS

FIGS. 3, 4 and 5 are front, rear and side views of the laterally extending window housing showing the vent member, folding door hinges and guides, and glass window accomodations, the side folding doors being shown, one each, in FIGS. 4 and 5, (one closed and the other open);

FIGS. 6 and 7 are front and top views of one of the side folding doors showing in detail the construction thereof; and FIG. 8 shows a tool for manipulating the vent and doors.

DESCRIPTION OF EMBODIMENTS OF THE INVENTION

Figure 1:
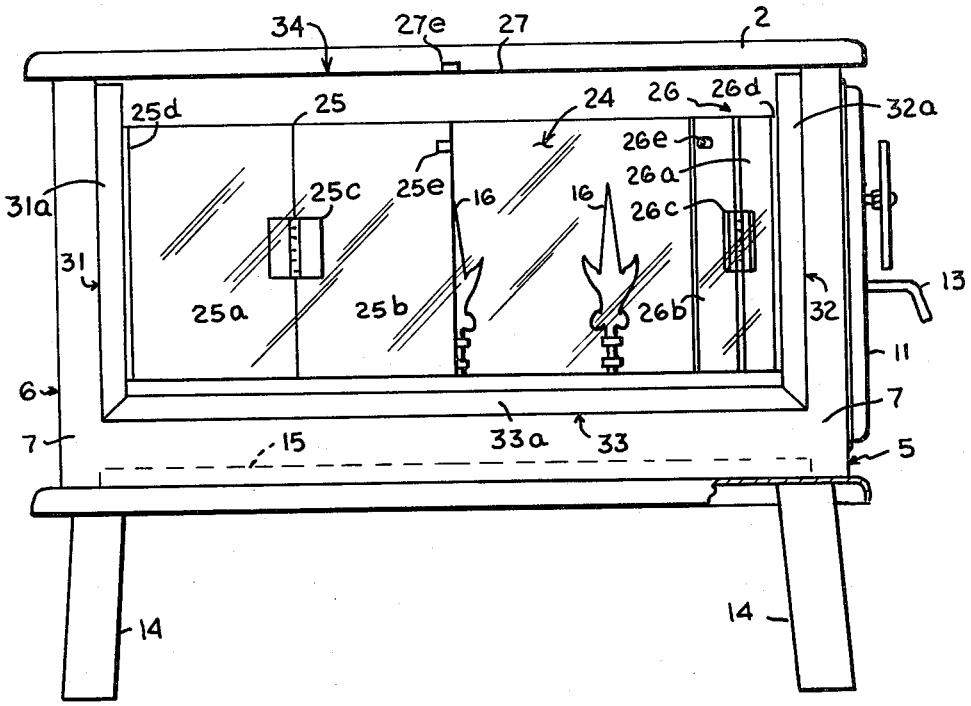
FIG. 1 is an exterior front view of the wood burning stove for use inside a home incorporating features of the present invention.
Figure 2:
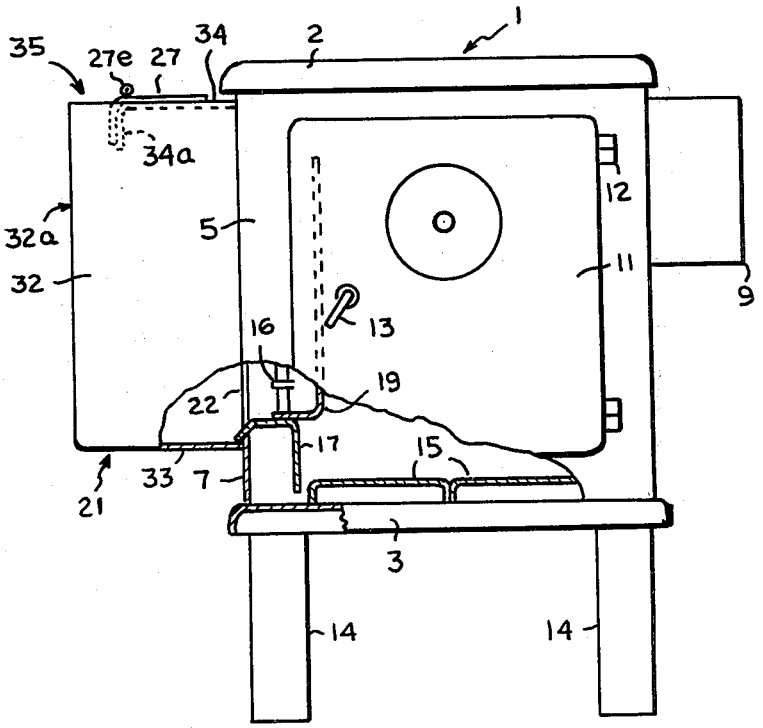
FIG. 2 is an exterior side view of the wood burning stove.

FIGS. 1 and 2 show an upstanding woodburning heater or stove for use in a room in a home to heat the room. The stove is upright, stands on legs on the floor and connects at the top or back to a flue available in the room. The general shape of the stove is rectangular and the major portion is the fire box that defines a regular parallelpiped figure standing on four legs with the major faces thereof being the front, back, top and bottom and the minor faces being the two sides.

The fire box 1 is a welded assembly of top and bottom plates 2 and 3, back plate 4, right side plate 5, left side plate 6 and front plate 7. The top and bottom plates extend slightly past the other plates where they connect to provide a decorative furniture-like appearance. The rear flue connection 9 is provided in the rear plates and connects to a flue provided in the room where the stove is located. For example, the rear flue connector can conveniently connect to the flue in a fire place located immediately to the rear of the stove.

Access to the fire box is through the side loading door 11 in the right side plate, the loading door hinges 12 being toward the rear and the door handle 13 being toward the front of the stove. Four supporting legs such as 14 extend down from the bottom plate, supporting the fire box about six inches off the floor. The overall dimensions of the stove from the top to the bottom of the legs is two to three feet, it is about a foot and one half deep and about three feet wide. Within the fire box, bottom pans 15 hold the combustables, such as logs, off the bottom plate 3 and decorative log irons, such as 16, are provided and carried by the log guard 17 that extends across the front of the fire box on the inside thereof and prevents the logs from falling into the front corner of the firebox. The bottom pans tend to shield the bottom plate 3 from the heat of the fire, and so the bottom plate of the fire box is relatively cool compared to the side, back and top plates. This is desirable so that heat radiated to the floor immediately below the stove is not excessive.

The viewing window assembly 21 including shielding doors and cooling air vent for cooling the glass window in the assembly is provided at the front face of the stove and is rectangular and nearly the same size as the front face of the stove and so through this window, substantially the whole interior of the fire box is viewed by the user. The glass window in this assembly protects the room from sparks and debris from the fire and yet permits enjoyment of the fire as a fire place while at the same time transmitting radiant heat from the fire.

A large rectangular opening 22 in front plate 7 of the fire box is provided. Extending laterally frontward from this opening is the window housing 21 that contains the glass plate window 24, left and right side folding shielding doors 25 and 26 and the air vent cover plate member 27 that controls the flow of cooling air in past the inside of the glass window. The window, shielding door and vent housing 21 is a welded assembly of front, top, bottom and side faces that attaches and welds to the opening 22 in the front of the fire box. For example, the housing may be a weldment of four parts, the left side 31, right side 32, bottom 33 and top 34. The sides 31 and 32 are plates (mirror images of each other) with returns 31*a* and 32*a* at the front that define the front frame of the window. The bottom is also a plate with a return 33*a* at the front to complete the bottom of the frame. The top plate 34 of the housing also has a return at the front 34*a*, but this return does not extend to meet the returns 31*a* and 32*a* and it does not frame the window. The return 34*a* is located several inches short of the returns 31*a* and 32*a* and defines the upper part of the shielding door frame which is several inches behind the window frame and defines a vent opening at the top of the housing from which cooling air flows in to cool the glass plate window. This opening is noted 35, it extends the full width of the window and it is covered by the air vent cover member 27.

The air vent cover member 27 extends the full width of the window and completely covers the opening between the window frame and the door frame at the top of the housing. For this purpose, the vent cover member 27 is an angle, having sides 27*a* and 27*b* that projects downward into the vent opening and extends from side to side thereof, so when the cover is moved to cover or uncover the vent, lateral movement is prevented by the housing sides. A handle 27*e* welded to the top of the vent member is a short length of steel pipe.

The two side folding doors 25 and 26 swing on verticle hinges at the extreme left and right, respectively, of the housing 21 and each door is made of two panels that hinge together at a vertical hinge. For example the left side folding door 25 is made of two panels 25*a* and 25*b* connected by hinge 25*c* and the left side of panel 25*a* is hung to the housing at door hinge assembly 25*d*. Similarly, the right side folding door 26 is made to two panels 26*a* and 26*b* connected by verticle hinge 26*c* and panel 26*a* is hinged to the housing at the extreme right by hinge assembly 26*d*. Door handles 25*e* on door 25 and 26*e* on door 26 are each short lengths of steel pipe of the same ID as the vent member handle 27*e* and are mounted to the inside panels of these doors on the outside thereof as shown in the Figures.

In operation, the shielding doors and the vent are manipulated by the user using a simple tool which is illustrated by FIG. 8. The tool consists of a handle 41 grasped by the user and a short length of bar 42 at the end of extension 43 from the handle that fits into any of the short lengths of the pipe that form the vent and door handles 27*e* and 25*e* and 26*e*. First, the user engages the vent handle 27*e* with the end 42 of the tool and pushes the vent member to the rear away from the glass window, opening the vent passage 35 at the top of the housing. This permits cooling air to flow in past the inside of the glass window and into the fire box. This flow also prevents smoke and debris from the fire from reaching the window.

When the vent passage 35 is open it allows insertion of the tool into the vent opening so that the end 42 of the tool can engage the shielding door handles 25*e* and 26*e*. For example the end 42 of the tool is inserted into handle 26*e* of door 26 from left to right so that the extension 43 of the tool is substantially vertical. Then the tool is pivoted counterclockwise as viewed from the top by the user who grips the handle 41 to do this. As the tool is rotated counterclockwise in this manner, the door 26 slides to the right folding inward toward the fire box as shown in the FIG. 1. By fully rotating in this manner the two panels of door 26 fold completely (even more than shown in FIG. 1) and so this door when completely folded, opens even more than shown in FIG. 1 and the folded end of the door projects slightly into the fire box just above the log guard 17. Then the tool is removed from the door 26 and inserted in the same way in the handle of door 25. In this case however, the tool is rotated clockwise causing door 25 to fold to the left in the same manner as door 26 is folded to the right. With the doors fully open and, or course, the vent open at the top of the housing the user can enjoy the log fire in the fire box by viewing through glass window and the window is protected by cooling air flow which prevents overheating that may cause the window to crack and/or accumulate soot. When the vent is open in this manner, cooling air flow is drawn in through vent passage 35, past the window 35 and into the fire box. When the doors 25 and 26 are fully open the hinged ends that project into the fire box are protected by shielding strips 18 and 19, respectfully, that are carried at each side by the log guard 17.

Turning next to FIGS. 3, 4 and 5 there are shown details of construction of the housing 21 that houses the glass plate window shielding doors and cooling air vent. FIG. 3 is a front view, FIG. 4 is a rear view and FIG. 5 is a side cross-section view of the housing. In both FIGS. 3 and 4 the two doors 25 and 26, the top vent cover 27 and the glass window 24 are all removed, except that FIG. 4 shows door 26 hinged to the door frame and in the closed position. However, FIG. 5 shows the glass window, the vent cover member and the left side shielding door 25 all in place with the vent open and the left side door in the fully open of folded position.

The window frame and retainer assembly 41 includes the side returns 31*a* and 32*a* and the bottom return 33*a*. Left and right side vertical side support angles 42 and 43 lend structural support to the housing and define side slot 44 and 45 into which the glass plate window 24 slides from the top of the housing. These angles 42 and 43 abut the glass window bottom support angle 46 at the bottom of the housing and are secured at the top of the housing by left and right side top support plates 48 and 49, respectively. Window gasket strip 47 cushions the window against the bottom angle 46. Thus, the glass window plate 24 is held in position at the window frame at the bottom of the housing cushioned by gasket 47.

A few inches behind the window is the door frame assembly 51, defined at the top of the housing by the return 34*b* of top plate 34, along the left and right sides of the housing by left and right side door frame strips 52 and 53 and along the bottom by door frame strip 54. These strips 52, 53 and 54 and return 34*b* define the door frame opening 55 in the housing, spaced several inches from the window 24 and so at the top of the housing the vent opening 35 is defined between the top edge of the glass window and the return 34*b* of the top plate 34 of the housing and covering this opening is the air vent cover 27.

On the inside of the door frame toward the fire box are located the top and bottom door frame guide angles 56 and 57. The top angle 56 together with the return 34*b* of the top plate of the housing define a transverse top door frame channel or guide extending substantially the full width of the door frame in which a guide rod at the cantilevered edge of a folding door rides. The doors 25 and 26 are suspended from left and right side hinge assemblies 61 and 62, 61 being shown in FIG. 5. Hinge assembly 61 includes at the top an angle bracket 63 attached to the return 34*a* and having a hole 67 to accomodate the pivot axle of door 25. The bottom of hinge assembly 61 is provided by a short length of pipe 68 into which the bottom end of the door pivot axle is inserted. Thus, the left side door 25 is hung by inserting its pivot axle into the hole 67 in angle 63 at the top nad into pipe 68 at the bottom. Similarly, the right side door 26 is pivotally mounted by inserting its axle into top hinge bracket 64 and bottom hinge pipe 66 at the right side of the housing. Details of construction of one of these folding doors (for example, door 25) are shown in FIGS. 6 and 7. These doors are constructed the same and are mirror images of each other except for the locations of the door handles 25*e* and 26*e;* they have to be staggered so they can be reached with the end of the tool manipulated by the user.

Folding door 25 shown by FIGS. 6 and 7 (as already described) consists of two panels 25*a* and 25*b* each having a short return (25*a'* and 25*b'*) at their abutting hinged ends where they hinge together by hinge 25*c*. These returns prevent the panels of the door from folding except in one direction and that is with the hinge on the inside. Hence, when the door is fully unfolded the panels are in line defining a common plane and when folded they are parallel to each other.

At the extreme end of panel 25*a* the pivot axle rod 25*d* is attached to the edge of the door panel as shown on the opposite side thereof from the hinge. This axle extends beyond the bottom of the door panel a dimension D and above the top of the door panel a dimension about 2D. Hence, when this axle is mounted to the upper hinge bracket 63 and lower pipe section 68, first the upper end of the axle, dimension 2D, is fully inserted into the hole 67 in the bracket 63 so that the other end, dimension D, just clears the top of the pipe 68 and, so can be inserted into the pipe until the bottom of the panel abuts the top of the pipe which leaves the top of the panel below the bottom of bracket 63 by dimension D. At the same time that the end 2D of the axle is inserted into bracket 63 at the top, the extending end (also dimension 2D) of rod 25*f* remains captured in the channel. Similarly, the folding door 26 is pivotally mounted in place at the other side of the housing with its axle 26*d* pivotally supported by bracket 64 at the top and pipe 66 at the bottom and with the extending portion of guide rod 26*f* at the other end of the door in the door track at the top of the housing.

The embodiments of the present invention described herein above represent the best known use of all the features of the invention and this embodiment incorporates all features of the invention. More particularly, it incorporates a novel construction of a shielding door for protecting the plate glass viewing window in a wood burning heater of a particularly novel construction. More particularly the unique arrangement of folding doors are manipulated open and closed by the user in conjunction with opening and closing a vent that controls the flow of cooling air past the glass window as necessary to protect the window from over heating and/of accumulation of soot thereon. Clearly, certain changes in the shape, size and/or arrangement of parts may be resorted to without departing from the spirit and scope of the present invention which are set forth in the appended claims.

What is claimed is:

1. A stove comprising in combination:

a housing enclosing a combustion chamber adapted to burn a solid fuel;

a side opening in said housing for viewing the interior of said combustion chamber;

a frame surrounding said side opening and secured to said housing;

a transparent panel supported by said frame at a fixed position spaced forwardly of said side opening;

a vent opening in said frame between said transparent panel and said side opening;

a vent cover movable on said frame between a closed position blocking said vent opening and an open position providing access therethrough to the space between said transparent panel and said side opening; and door means mounted on said frame within said space, said door means being accessible solely through said vent opening when said vent cover is open and being adjustable between an open position exposing said transparent panel to the interior of said combustion chamber and a closed position providing a protective heat shield between said transparent panel and the interior of said combustion chamber.

2. The stove as claimed in claim 1 wherein said door means comprises a pair of foldable door members.

3. The stove of claim 2 wherein said door members are foldable and pivotally adjustable about vertical axes between said open and closed positions.

* * * * *